United States Patent [19]

Wiener

[11] 4,199,972

[45] Apr. 29, 1980

[54] GRIPPING OR PRESSING APPLIANCE

[75] Inventor: Hans Wiener, Täby, Sweden

[73] Assignee: PressMaster A.B., Stockholm, Sweden

[21] Appl. No.: 852,724

[22] Filed: Nov. 18, 1977

Related U.S. Application Data

[63] Continuation-in-part of Ser. No. 647,641, Jan. 8, 1976, Pat. No. 4,078,303.

[30] Foreign Application Priority Data

Dec. 15, 1976 [GB] United Kingdom ..... 52366/76

[51] Int. Cl.[2] ..... B21D 37/12

[52] U.S. Cl. ..... 72/409; 81/419

[58] Field of Search ..... 72/431, 384, 409, 410; 81/418, 425 R, 427, 428 R, 419

[56] References Cited

U.S. PATENT DOCUMENTS

| | | | |
|---|---|---|---|
| 920,834 | 5/1909 | Deevy | 72/409 |
| 2,743,634 | 5/1950 | Badeau | 72/431 |
| 2,814,222 | 11/1957 | Sanders | 72/409 |
| 3,417,599 | 12/1968 | Burns | 72/431 |

FOREIGN PATENT DOCUMENTS

| | | | |
|---|---|---|---|
| 340581 | 9/1921 | Fed. Rep. of Germany | 72/384 |
| 80554 | 8/1919 | Switzerland | 72/409 |

*Primary Examiner*—Lowell A. Larson
*Attorney, Agent, or Firm*—Karl F. Ross

[57] ABSTRACT

A tool such as a vise or a pair of pliers has two relatively movable jaws linked via respective shanks with operating means such as a pair of handles, each jaw comprising an elongate base with upstanding parallel webs having workpiece-engaging faces alternately inclined in opposite directions. To facilitate the interfitting of these webs in a working position, particularly with pivotally interconnected shanks whose pivotal axis parallels the planes of the webs, the jaws are swingably mounted on their shanks with swing axes parallel to the pivotal axis. One shank is connected to its handle by way of an interposed resilient pad of adjustable elasticity.

5 Claims, 3 Drawing Figures

GRIPPING OR PRESSING APPLIANCE

CROSS-REFERENCE TO RELATED APPLICATION

This application is a continuation-in-part of my prior application Ser. No. 647,641 filed Jan. 8, 1976, now patent No. 4,078,303.

FIELD OF THE INVENTION

My present invention relates to an appliance or tool, such as a pair of pliers or a vise, for the handling of workpieces of generally circular cross-section.

BACKGROUND OF THE INVENTION

Tools for gripping or holding a workpiece generally have two relatively movable jaws mounted on shanks which are either pivotally interconnected for relative swinging motion, as in pliers or tongs, or capable of parallel translatory motion, as in a vise or a clamp.

In order to exert a firm grip on an engaged workpiece, it is desirable to provide each jaw with a multiplicity of engagement faces. In such a case, however, the relative positioning and spacing of these faces may cause some problems particularly with tools of the pivotal kind.

OBJECTS OF THE INVENTION

The general object of my present invention is to provide a simple but effective jaw structure adapted to engage workpieces of widely varying diameters.

A more particular object is to provide means for facilitating the coaction of two multiface jaws in a plier-type tool.

SUMMARY OF THE INVENTION

In accordance with one aspect of my present invention, already disclosed in my prior application and patent, each jaw has an elongate base with a multiplicity of parallel webs transverse thereto, these webs having faces alternately inclined in opposite directions at an acute angle to a longitudinal plane of symmetry of the base. The planes of symmetry of the two bases substantially coincide with each other at least in a working position, into which the jaws are displaceable from a withdrawn position by associated operating means, with correspondingly inclined web faces of the two jaws confronting each other for gripping a workpiece which has been inserted between the jaws in their withdrawn position. In their working position, the webs of one jaw having faces inclined in one direction are interleaved with the webs of the other jaw having faces inclined in the other direction, thereby forming a channel contracting around the workpiece upon displacement of the operating means in a jaw-closing direction.

The interleaving of the webs of the coacting jaws presents no problem if the jaws execute a translational movement or if the webs lie in planes parallel to the direction of motion, e.g. in planes transverse to a pivotal axis (cf. FIGS. 5 and 10 of my prior U.S. Pat. No. 4,078,303). With web planes parallel to that axis, however, the web spacing will have to be substantially larger than their thickness (in the presence of webs of identical thickness on both jaws) if the web positions are fixed with reference to the shanks on which they are carried. Pursuant to another aspect of my present invention, this inconvenience is avoided by a swingable mounting of the jaws on their shanks, with swing axes parallel to the pivotal axis of these shanks, so that their workpiece-gripping projections can be interleaved as easily as if the jaws were moving parallel to each other.

BRIEF DESCRIPTION OF THE DRAWING

The above and other features of my invention will now be described with reference to the accompanying in detail drawing in which.

DETAILED DESCRIPTION

Figures 1, 2, 3:
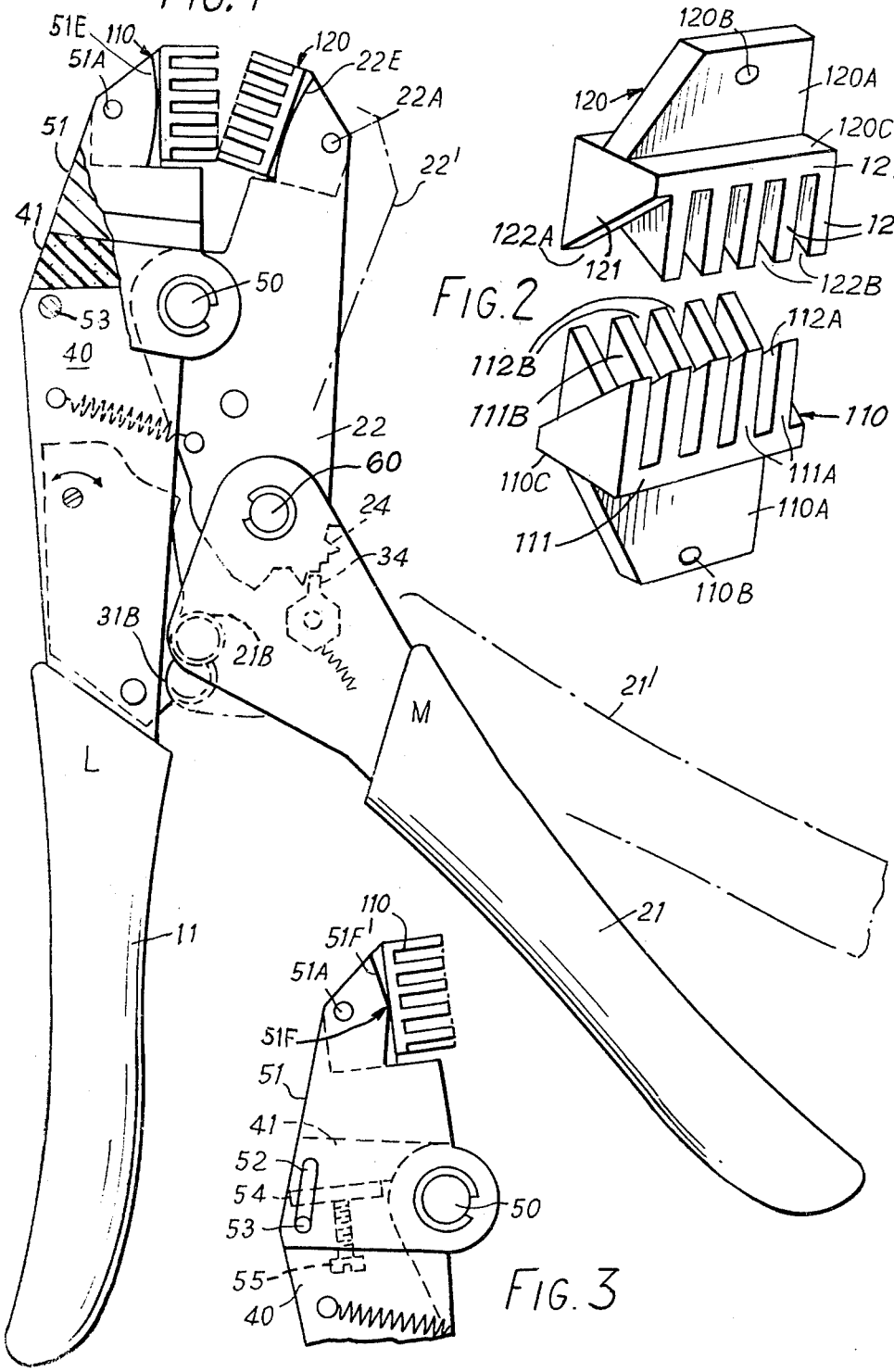
FIG. 1 is a front elevation of a pair of crimping pliers according to the present invention.
FIG. 2 shows in greater detail the working jaws of the pliers of FIG. 1.
FIG. 3 is an elevational view showing a shank of the pliers according to FIG. 1 in greater detail and in a slightly modified form.

In FIG. 1 I have shown a tool embodying my invention, specifically a pair of crimping pliers with handles 11 and 21 which form the operating means of the appliance. The movement of the handle 21 relative to the handle 11 is transmitted via a cam-and-cam follower mechanism 21B, 31B, of a type more fully described in U.S. Pat. No. 4,048,877, to a limb or shank 22 which is articulated by a pivot pin 60 to handle 21 and by another pin 50 to a tool body 40 to which the handle 11 is rigidly attached. Also pivotally mounted on the pin 50 is a limb or shank 51 which carries a working jaw 110. A co-operating working jaw 120 is mounted on the limb 22. Between limb 51 and the body 40 there is interposed a block 41 of elastomeric material, such as natural or synthetic rubber or polyurethane. A slot 52 (FIG. 3) in the limb 51, co-operating with a pin 53 on the body 40, limits the pivotal movement of the limb 51 relative to the body 40. It will be readily understood that the may be prestressed to a desired extent by block 41 selecting the dimensions of the block 41 relative to the dimensions of the space between the body 40 and the limb 51 into which the block 41 is fitted. The handle 21 and the associated shank 22 are shown in phantom lines in their fully withdrawn positions 21', 22' in which the jaws 110, 120 are farthest from each other.

FIG. 5 shows means for a selective precompression of the elastomeric block 41. A movable plate 54 is interposed between the tool body 40 and the block 41. An adjustment screw 55 is threaded inside the hollow body 40 into a nut (not shown) secured to that body. By moving the plate 54 upwardly in FIG. 3, a prestress is applied to or increased in the elastomeric block 41, as the abutment of the pin 53 against the lower end of the slot 52 prevents such a movement of the plate 54 from being translated into a clockwise swing of the limb member 51.

The working jaws 110, 120 are shown on a larger scale and in more detail in FIG. 2. These jaws have the structure described and illustrated in my prior U.S. Pat. No. 4,078,303, comprising respective elongate bases 111, 121 with two interleaved groups of mutually parallel webs 111A, 111B and 121A, 121B rising therefrom, these webs forming engagement faces which are alternately inclined in opposite directions with reference to a longitudinal plane of symmetry of their base. The webs of each group are separated by gaps 112A, 112B and 122A, 122B accommodating respective webs of the other jaw when the handles 11, 21 are squeezed to establish a working position for the gripping of a workpiece of rounded cross-section, e.g. a pipe or cable as shown in my prior patent. The engagement faces of the two web groups of a jaw, being mutually symmetrical, intersect at the aforementioned plane of symmetry; each web, upon approaching or entering the corresponding gap of the opposite jaw, confronts another web whose engagement face is parallel to its own. Thus, the interengaging webs of the jaws moving into their working position form a closed channel about an engaged workpiece whose diameter may vary within wide limits.

It will be noted that the bases of jaws 110, 120 are shown in FIGS. 1 and 2 to be so positioned that their webs lie in planes parallel to the pivotal axis of pin 50 so that their interleaving by a relative swinging of their shanks 22, 51 would require a certain widening of their gaps—in comparison with a tool such as a vise in which the jaws move parallel to each other—if these jaws were rigid with their respective shanks. According to an advantageous feature of my invention, however, each jaw is provided with a lug 110A, 120A (FIG. 2) mounted on a respective pivot pin 22A, 51A. Thus the two jaws 110, 120 and their webs, such as 111A, can align themselves automatically when, after an initial engagement shown in FIG. 1, the shanks 22, 51 are moved closer together. The gaps 112, 122 may therefore, even in the case of a pivotal pincer movement, be narrower than when the jaws 110, 120 are mounted solidly on the respective limb shanks. Regardless of the actual jaw structure, the swingable mounting of at least one of the working jaws compensates to a certain extent for the pivotal movement of the shank about its fulcrum 50. To relieve the pivots 22A; 51A from too high a stress, backing surfaces 22E, 51E formed on the shanks 22, 51 are arcuately curved about the respective pins 22A, 51a, which pass through openings 110B, 120B in the lugs 110A, 120A each spaced from the rear face 110C, 120C of the respective jaw base 111, 121 by a distance equal to the radius of curvature of the corresponding backing surface. Thus, the rear faces 110C, 120C bear upon the curved surfaces 22E, 51E in each position of the working jaws 110, 120. A modified backing surface 51F, shown in FIG. 3 for the shank 51, is gabled and has two flat sections including an obtuse angle with each other, one section 51F' preferably giving support along its entire length to the jaw 110 in a completely closed position of the two shanks 22, 51.

In crimping pliers and similar appliances it is customary to provide a pawl-and-ratchet mechanism which does not permit the tool to be reopened before the compressing operation performed by the tool has been completely finished. A mechanism of this kind, more fully described in the aforementioned U.S. Pat. No. 4,048,877, and comprises a ratchet 24 and a pawl 34, shown dotted in FIG. 1.

It will be appreciated that the swingable mounting of the working jaws 110, 120 on the pivotally interconnected shanks by means of pins 22A, 51A, with or without the curved backing surfaces 22E, 51E, affords the same advantage, i.e. the possiblity to make the gaps 112, 122 narrower, also in tools not provided with a resilient block 41, or in tools where the resilient member is interposed in the power-transmitting path at a different location, as long as it does not affect the relative position of the two working jaws. From FIG. 1 it will be apparent that the intended function of the resilient member is also achieved if this member is inserted at either or each of two intermediate locations L, M on handles 11, 21. The resilient block 41 or its equivalent can also be placed on the shank 22, e.g. by rotating it from its illustrated position through approximately 180° around the pivot 50.

It is obvious that such a resilient member may be interposed or incorporated in each of the force-transmitting paths formed by handles 11, 21 and shanks 51, 52.

At the beginning of a squeezing operation, large and small workpieces alike will be gripped with substantially equal force because at that stage the compression of the resilient member begins. In the case of workpieces of small diameter, the start of this compression lies close to the final working position of the operating means so that only a relatively moderate increase in the compression of the resilient member will be achieved before that limiting position is reached. In the case of larger-diameter workpieces, the initial engagement between the jaws and the workpiece will take place already in an early stage of the closure stroke and the compression of the resilient member will continue during the remainder of that stroke so as to reach a higher degree than in the former case before the operating means is finally stopped in its terminal position.

The resilient member may have a predetermined nonlinear operating characteristic and, e.g. comprise or consist of a bundle of leaf springs whose individual members are successively engaged during the closure stroke.

I claim:

1. A tool for handling workpieces of generally circular cross-section, comprising a first jaw and a second jaw each having a base provided with workpiece-gripping projections, and operating means including a pair of pivotally interconnected shanks enabling relative swinging of said jaws in a plane transverse to the pivotal axis between a withdrawn position allowing insertion of a workpiece between said jaws and a working position in which the projections of said jaws are mutually interleaved, said jaws being swingably mounted on said shanks with swing axes parallel to said pivotal axis for facilitating the interleaving of their projections upon approaching said working position; said shanks being provided with respective backing surfaces disposed between said swing axes and said jaws for engaging the bases thereof at least in said working position.

2. A tool as defined in claim 1 wherein said backing surfaces are curved about said swing axes.

3. A tool as defined in claim 1 wherein said backing surfaces are gabled and form sections adjoining one another at an obtuse angle.

4. A tool as defined in claim 1, further comprising resilient means inserted between said operating means and one of said jaws.

5. A tool as defined in claim 4 wherein said resilient means comprises an elastic pad provided with adjusting means for varying its resiliency.

* * * * *